United States Patent [19]

Marchewka et al.

[11] 4,091,632

[45] May 30, 1978

[54] BEVERAGE COOLING DEVICE HAVING CONSUMABLE FOODSTUFF THEREIN

[76] Inventors: Richard B. Marchewka; Laima Marchewka, both of 3200 S. Racine, Chicago, Ill. 60606

[21] Appl. No.: 652,821

[22] Filed: Jan. 27, 1976

[51] Int. Cl.[2] ..... F25C 1/00

[52] U.S. Cl. ..... 62/1; 62/530; 229/87 F; 249/61; 426/85; 426/134

[58] Field of Search ..... 62/1, 529, 530; 426/85, 426/134, 249, 393, 410, 515; 206/548; 229/87 F, 51 TS; 249/61

[56] References Cited

U.S. PATENT DOCUMENTS

| | | | |
|---|---|---|---|
| 490,902 | 1/1893 | Galbreath | 62/529 |
| 740,847 | 10/1903 | Glebsattel | 62/530 |
| 1,329,466 | 2/1920 | Miller | 229/51 TS X |
| 1,669,237 | 5/1928 | Gingras | 229/51 TS X |
| 1,758,008 | 5/1930 | Mock | 62/530 X |
| 2,036,706 | 4/1936 | Law | 426/85 |
| 2,152,467 | 3/1939 | Crosby | 62/530 |
| 2,264,971 | 12/1941 | Glennan | 62/530 |
| 2,370,931 | 3/1945 | Bogin et al. | 426/85 X |
| 2,521,995 | 9/1950 | Priddy | 426/515 X |
| 2,713,543 | 7/1955 | Peters | 426/85 X |
| 2,975,925 | 3/1961 | Chambers | 426/85 X |
| 3,001,644 | 9/1961 | Fourness et al. | 229/51 TS X |
| 3,259,235 | 7/1966 | Sowle | 229/51 TS X |
| 3,550,764 | 12/1970 | Tigner | 229/51 TS X |
| 3,940,232 | 2/1976 | Stock | 62/530 X |

*Primary Examiner*—William E. Wayner
*Assistant Examiner*—William E. Tapolcai, Jr.
*Attorney, Agent, or Firm*—Thomas R. Vigil

[57] ABSTRACT

The beverage cooling device includes a semi-flexible plastic container and a liquid foodstuff which is totally enclosed within the container. The container and its contents are adapted to be frozen and utilized as a beverage cooling device. While the liquid foodstuff is in the frozen state within the container, the container may be broken open to remove the frozen liquid to permit the same to be used simultaneously as a coolant and as a flavoring for the beverage. Alternatively, the frozen foodstuff can be consumed directly. On the other hand the device can be allowed to cool within a drinking vessel to cool a liquid or beverage therein and then refrozen for reuse.

9 Claims, 4 Drawing Figures

BEVERAGE COOLING DEVICE HAVING CONSUMABLE FOODSTUFF THEREIN

BACKGROUND OF THE INVENTION

1. The Field of the Invention

This invention relates to beverage coolants and more particularly to that class adapted to optionally add flavoring or nutritional value to the contents of a drinking container.

2. Description of the Prior Art

The prior art includes individual containers adapted with reusable closure means that permit water to be included within the container intended to be frozen and utilized repeatedly as a non beverage diluting ice cube. The instant invention possesses this capability but permits the contents of the container to be optionally included as part of the beverage, when in the frozen or unfrozen state, and alternatively, to be directly consumed by the user.

SUMMARY OF THE INVENTION

Ice cubes have been added to beverages to cool them resulting in a gradual dilution of the beverage as the ice cube melts. The apparatus disclosed herein defines the shape of the ice cube fabricated by enclosing a discreet quantity of liquid to be frozen in a three dimensional semi rigid plastic container. The unopened container with the frozen liquid within may be employed to cool a beverage by dropping one or more cooled enclosures into a tumbler containing the beverage to be cooled. The enclosure is adapted with means to strip the enclosure away from the frozen contents thereofin such a manner so as to permit the three dimensional frozen element remaining to be utilized as a beverage coolent or to be consumed in a manner familiar to the techniques utilized to consume frozen sweetened desserts currently served to consumers on a wooden or plastic stick utilized to support the consumable. The container may be adapted with spout means such that the contents therein are permitted to be emptied from the container when in the liquid state. Alternatively, the container may be entirely peeled away from the frozen contents within permitting the contents to be utilized as above described. Uses include iced tea and coffee liquid concentrates, syrups utilized to fabricate non-carbinated and carbinated beverages, sweetened slush-like foodstuffs utilized to fabricate frozen stick supported desserts, and water utilized to cool beverages when retained in or removed from the container.

A primary object of the instant invention is to provide a novel inexpensive apparatus containing a consumable beverage coolant.

Another object is to provide a means to cool a beverage without causing dilution thereof.

Still another object is to provide a means to conveniently cool and provide flavoring to a beverage.

Yet another object is to provide a container permitting beverage flavorings to be removed therefrom in the liquid or frozen states.

A further object is to provide a beverage coolant adapted to utilize water or a foodstuff within.

Another object is to provide an apparatus capable of molding frozen beverage coolants in a variety of pleasing shapes.

Still another object is to provide a beverage coolant and beverage foodstuff additive which may be utilized in combination with a conventional straw.

These objects, as well as other objects of this invention, will become readily apparent after reading the following description of the accompanying drawings.

DESCRIPTION OF THE PREFERRED EMBODIMENT

The structure and method of fabrication of the present invention is applicable to a consumable beverage coolant device made of a semi-flexible plastic material. In the illustrated embodiment, the device is in the shape of a hollow sphere having a hollow tube whose longitudinal axis passes through the origin of the sphere and whose free ends are adapted to communicate with the walls comprising the sphere. The cavity included within the sphere is totally enclosed by the interior spherical walls and the external cylindrical walls of the cylinder passing therethrough. A liquid foodstuff is contained within the cavity and retained therein by sealing of a filling port passing through a point on the surface of the sphere. A drinking straw of conventional design is permitted to pass through the right angle cylinder encaptured in part thereby so that the container may be conveniently retreived after use in cooling a beverage.

Portions of the walls of the spherical shaped outermost container elements are weakened along a well defined series of pathways permitting the container to be stripped open releasing the liquid or frozen liquid contents of the container for use in flavoring applications or in cooling applications. The pathway includes a circular weakened line corresponding with one edge at one end of the right angle cylinder and a plurality of parallel longitudinal lines eminating therefrom to a circular line of unweakened container material, appearing at the other free edge at the other end of the right angle cylinder. Separating the material comprising the container along one or more longitudinal weakened lines permits, alternatively, the liquid stored within the sphere to be poured therefrom or to be removed therefrom intact, when in a frozen state. The weakened pathways do not permit individual portions comprising the surface of the sphere to be removed from the remaining portions of the material comprising the sphere, but rather follows a course such that all the material comprising the sphere and the right angle cylinder element therethrough remain as an integral unitary container that has been opened along the weakened pathways rather than a container separated into discreet individual independent number of sections.

Figure 1:
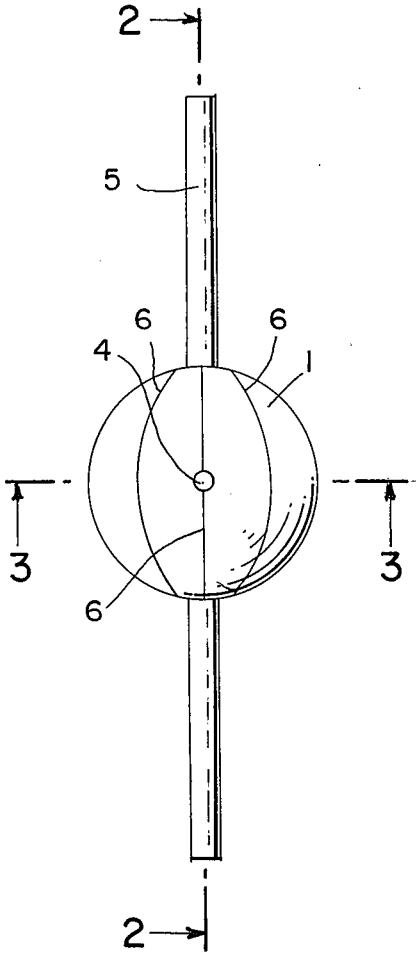
FIG. 1 illustrates an elevation view of a spherical consumable beverage coolant adapted with a straw therethrough.

Now referring to the Figures, and more particularly to the embodiment illustrated in FIG. 1 showing the container 1 having a sealed off filling spout 4 adapted to fasten along the length of a drinking straw 5. Weakened longitudinal pathways 6 permit the container 1 to be stripped apart therealong.

Figure 2:
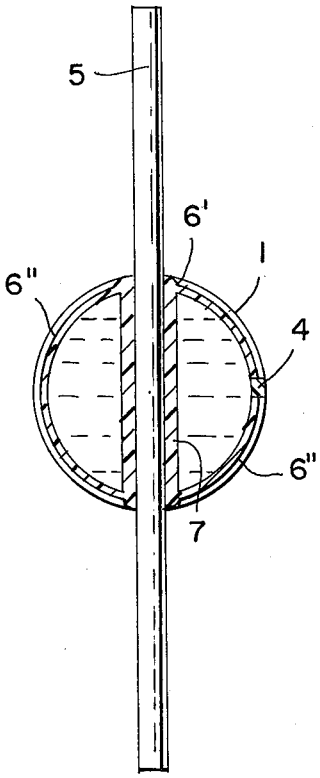
FIG. 2 is a cross-sectional view taken along line 2—2 viewed in the direction of arrows 2—2 as shown in FIG. 1.

FIG. 2 is a cross-sectional view taken along line 2—2 viewed in the direction of arrows 2—2 as shown in FIG. 1 showing the hollow drinking straw 5 passing through the opening in a right angle cylinder 7 adapted to fasten to the walls of container 1. Filling spout 4 is shown projecting outwardly from the surface of container 1. Weakened line 6' as illustrated shows the ends of a circular weakened pathway near the uppermost edge of cylinder 7. Weakened pathways 6" indicate the presence of longitudinal weakened pathways extending from circular pathway 6' downwards along longitudinal lines towards the projection of the surface of the cylinder upon the outermost spherical walls of the container.

Figure 3:
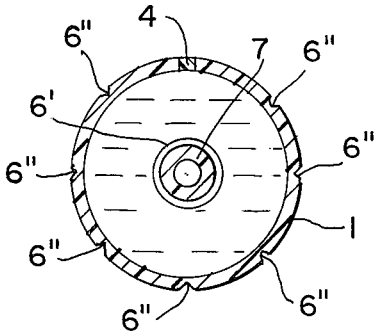
FIG. 3 is a cross-sectional view taken along line 3—3 viewed in the direction of arrows 3—3 as shown in FIG. 1.

FIG. 3 is a cross-sectional view taken along line 3—3 viewed in the direction of arrows 3—3 as shown in FIG. 1 illustrating a plurality of longitudinal pathways 6" uniformly spaced about the equator of spherical container 1 and including filler spout 4 thereabout. Circular pathway 6' is shown adjacent the outermost surface of the right angle cylinder 7.

Figure 4:
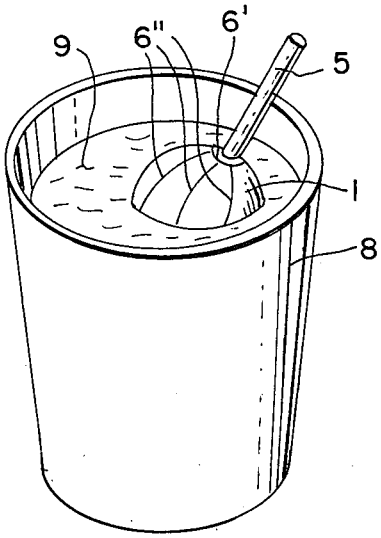
FIG. 4 is a perspective view of the spherical consumable beverage coolant and straw combination shown in FIG. 1 included within a beverage shown in a tumbler.

FIG. 4 shows a tumbler 8 containing a liquid 9 therein. Straw 5 is shown eminating from container 1 shown partially submerged within liquid 9. Surface weakened pathways 6" are illustrated as longitudinal lines eminating downwardly from circular weakened pathway 6' shown adjacent the area through which one side of straw 5 passes through the surface of spherical container 1. Separating one or all longitudinal weakened lines 6" permits the contents within container 1 to be emptied or removed entirely from within the confines of container 1 for use as a liquid beverage flavoring or for use as a solid beverage coolant or for use as a solid or liquid beverage coolant which flavors the beverage.

One of the advantages is a novel inexpensive apparatus containing a consumable beverage coolant.

Another advantage is a means to cool a beverage without causing dilution thereof.

Still another advantage is a means to conveniently cool and provide flavoring to a beverage.

Yet another advantage is a container permitting beverage flavorings to be removed therefrom in the liquid or frozen states.

A further advantage is a beverage coolant adapted to utilize water or a foodstuff within.

Another advantage is an apparatus capable of molding frozen beverage coolants in a variety of pleasing shapes.

Still another advantage is a beverage coolant and beverage foodstuff additive which may be utilized in combination with a conventional straw.

Thus, there is a disclosed in the above description and in the drawings, an embodiment of the invention which fully and effectively accomplish the objects thereof. However, it will become apparent to those skilled in the art, how to make variations and modifications to the instant invention. For example, the container can be translucent or can be colored with the coloring indicating the type of foodstuff contained therein. Therefore, this invention is to be limited not by the specific disclosure herein, but only by the appending claims.

The embodiment of the invention in which an exclusive privilege or property is claimed are defined as follows:

1. A beverage cooling device having a compact size and shape so as to be easily inserted into, and received into, an individual drinking vessel, such as a drinking glass, for cooling a liquid therein and adapted to either be reused, if desired, or to be broken open to remove edible contents therein and then discarded, said device comprising a closed, semi-flexible plastic container and a consumable flavored liquid situated within said container and capable of being frozen while so situated within said container, said container having a selected three dimensional shape, sealable entrance means for facilitating filling of said container with said liquid and permitting sealing of said container after it is filled with said liquid, and container opening means for opening said container to facilitate removal of said liquid in a unitary frozen solid state from said container.

2. The device according to claim 1 wherein said liquid comprises foodstuffs.

3. The device according to claim 2 wherein the color of said container indicates the type of foodstuff contained therein.

4. The device according to claim 1 wherein said three dimensional shape comprises a hollow sphere having the edges at both ends of a hollow right angle cylinder connecting to the walls thereof, the longitudinal axis of said right angle cylinder passing through the origin of said sphere, the entire peripheral length of said edges at both ends of said right angle cylinder fixedly secured to said walls forming thereby a closed hollow container.

5. The device according to claim 4 further comprising a hollow straw adapted to pass through the opening in said right angle hollow cylinder.

6. The device according to claim 4 wherein said opening means comprises at least one weakened area of said container which extends along a line that follows a partially circular course beginning at one edge at one end of said right angle hollow cylinder and extending to an opposite edge at the other end of said cylinder.

7. The device according to claim 6 wherein said opening means comprises a plurality of weakened areas of said container, each weakened area extending along a separate line which follows a partially circular course beginning at one end of said right angle hollow cylinder and extending to an opposite edge at the other end of said cylinder.

8. The device according to claim 1 wherein said container is translucent.

9. The device according to claim 1 wherein said opening means comprises at least one weakened area of said container, said weakened area extending along a line on said container and facilitating tearing open of the container to remove the frozen solid liquid therefrom.

* * * * *